United States Patent [19]

Schutt

[11] 4,400,259

[45] Aug. 23, 1983

[54] DEEP ANODE ASSEMBLY

[75] Inventor: William R. Schutt, Doylestown, Pa.

[73] Assignee: Matcor, Inc., Doylestown, Pa.

[21] Appl. No.: 293,900

[22] Filed: Aug. 18, 1981

[51] Int. Cl.[3] ..... C23F 13/00

[52] U.S. Cl. ..... 204/196; 204/147; 204/286; 204/297 R

[58] Field of Search ..... 204/147, 148, 196, 197, 204/286, 297 R

[56] References Cited

U.S. PATENT DOCUMENTS

| | | | |
|---|---|---|---|
| 2,916,429 | 12/1959 | Vossnack et al. | 204/196 |
| 3,458,643 | 7/1969 | Dorr | 204/196 |
| 3,725,669 | 4/1973 | Tatum | 204/196 |
| 4,056,446 | 11/1977 | Vennett | 204/197 |
| 4,089,767 | 5/1978 | Sabins | 204/197 |
| 4,170,532 | 10/1979 | Tatum | 204/196 |
| 4,251,343 | 2/1981 | Peterson et al. | 204/148 |

*Primary Examiner*—T. Tung

*Attorney, Agent, or Firm*—Caesar, Rivise, Bernstein & Cohen, Ltd.

[57] ABSTRACT

A cathodic protection system having a deep bed anode assembly including a readily replaceable anode. The anode assembly is located within a deep bore hole which is filled with an electrically conductive particulate material up to a predetermined height. The assembly comprises a base assembly located on the bottom of the bore hole, a first conduit extending the full length of the bore hole to the base, and a second conduit connected to the first conduit adjacent the top of the bore hole and extending to a depth slightly below the height of the conductive material and a third conduit extending the full length of the bore hole and perforated along the portion within the electrically conductive material. A small diameter wire electrode extends through the electrically conductive material and is connected at its upper end in a cable extending through the first conduit and at its lower end in a cable passing through the base assembly and the first conduit. Both cables are connected to a rectifier located on the surface remote from the bore hole. Rope guide means are connected to the two cables and extend parallel with the assembly of the cables and anode.

24 Claims, 6 Drawing Figures

FIG. 3
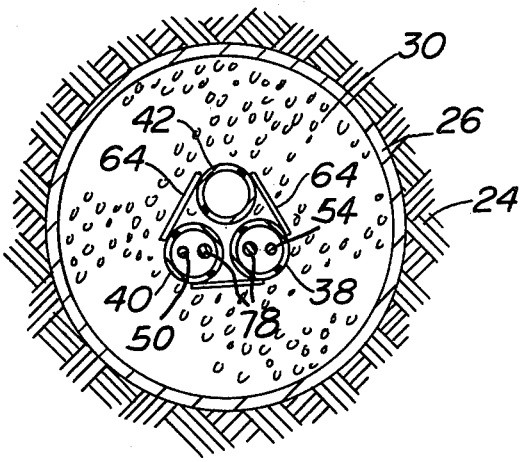
FIG. 4
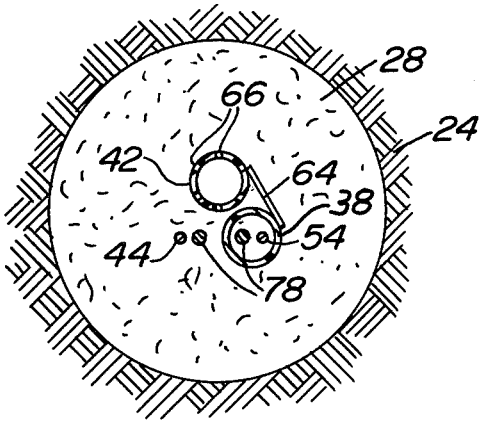
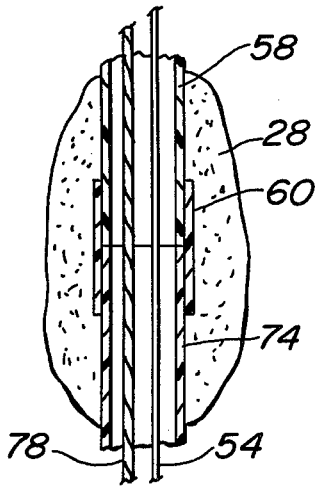
FIG. 5
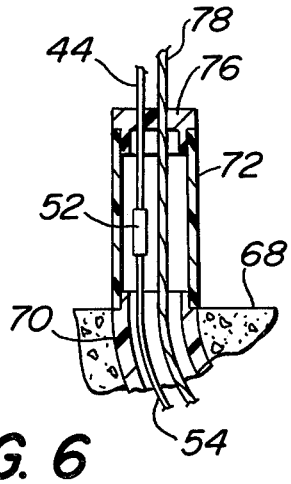
FIG. 6

DEEP ANODE ASSEMBLY

This invention relates generally to cathodic protection systems, and particularly, to impressed current cathodic protection systems.

In order to protect buried metal structures, such as pipelines, power cables, underground transformers, etc., it is a common practice to use cathodic protection systems. One type of cathodic protection system is called an impressed current system and operates by neutralizing the galvanic current produced in the burial medium, usually the ground, and the structure to be protected. One type of impressed current system is known as a rectifier-ground bed installation. In a common type of rectifier-ground bed installation, an external source of potential is provided to a buried anode, via an existing AC power supply (although the power can be provided via other means, such as, for example, gas driven generators, etc.). Coupled to the AC power supply is a rectifier whose positive terminal is connected to a string of anodes, which are referred to as the ground bed, and which are buried adjacent the structure bed. The negative terminal of the rectifier is connected to the structure. In common practice, the anodes of the ground bed can be connected in any number of configurations, e.g., series, parallel, etc., and are commonly formed of various materials, such as graphite, carbon, silicon iron etc.

The efficacy of ground bed systems is a function of the resistivity of the soil in which the anodes are buried, the number of anodes, the spacing between anodes, the distance to the buried structure, etc. For example, the higher the ground resistivity, the greater the number of anodes required to cover a desired area. Inasmuch as the resistivity of the soil is usually lower at greater depths, it is a common practice to dispose the anodes at substantial depth, e.g., 100 or more feet, below the surface. At such depths, the soil tends to be less resistive due to its compositional makeup and/or the presence of water. Depending upon the application, deep bed anodes can be disposed at depths from 100 feet (30.5 m) to 800 feet (244 m) or more, with 150 feet (91.5 m) being average.

Various deep anode bed systems have been disclosed in the patent literature. For example, in U.S. Pat. No. 3,725,669 (Tatum), there is disclosed an impressed current, deep anode bed, cathodic protection system. That system makes use of a long tube extending down the bore hole and in which tube one or more anodes are suspended. The bore hole is filled with a granular, electrically conductive material, e.g., coke breeze, so that the current from the anode spreads out readily therefrom.

While the system of the Tatum patent appears generally suitable for its intended purposes, it is somewhat complex in structure and provides only limited means for the replacement of any of its anodes in the event of anode failure or preventive maintenance.

Other prior art deep anode bed cathodic protection system also suffer from various disadvantages, such as complexity, cost, ability to replace anodes expeditiously, etc.

Accordingly, it is a general object of the instant invention to provide an anode assembly for use in a deep anode bed application which overcomes the disadvantages of the prior art.

It is a further object of the instant invention to provide a deep anode bed assembly for use in a bore hole which is simple in construction and can be readily located in place.

It is a further object of the instant invention to provide a deep anode bed assembly for cathodic protection system which enables the expeditious removal and/or replacement of the anode.

It is a further object of the instant invention to provide a deep bed anode assembly arranged to exhibit long life, yet enable the ready replacement or renewal of the anode.

It is still a further object of the instant invention to provide a deep bed anode assembly in which the anode comprises a duel feed continuous wire extending for a substantial distance down the bore hole and centered radially therein.

These and other objects of the instant invention are achieved by providing a deep bed anode assembly for use in a cathodic protection system. The deep bed anode assembly is arranged for disposition within a bore hole which is filled with an electrically conductive material from its bottom to a first point in the bore hole. The deep bed anode assembly comprises a weighted bottom assembly arranged for disposition at the bottom of the bore hole, first conduit means extending the depth of the bore hole and connected to the bottom assembly. An electrically conductive, elongated anode is located within the bore hole, extends between the bottom assembly and the top of the bore hole and is located substantially centrally radially within the bore hole. The anode has an upper end to which a first conductor or cable is connected and a lower end to which a second conductor or cable is connected. The first conductor extends through the bore hole for connection to a current supply means located outside of the bore hole. The second conductor extends through the base assembly and up through the first conduit means for connection to said supply.

Other objects and many of the attendant advantages of the instant invention will be readily appreciated as the same becomes better understood by reference to the following detailed description when considered in connection with the accompanying drawing wherein:

FIG. 3 is an enlarged sectional view taken along line 3—3 of FIG. 1;

FIG. 4 is an enlarged sectional view taken along line 4—4 of FIG. 1;

FIG. 5 is an enlarged sectional view taken along line 5—5 of FIG. 1; and FIG. 6 is an enlarged sectional view taken along line 6—6 of FIG. 1.

Figure 1:
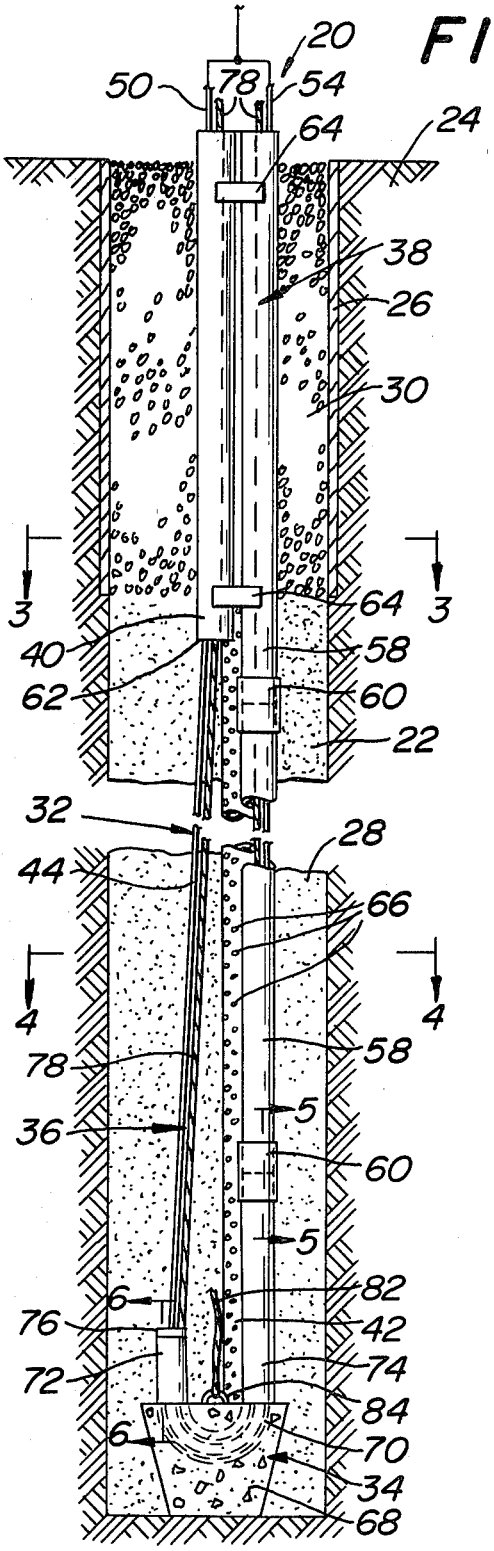
FIG. 1 is a side elevational view of a portion of a deep bore hole showing the deep bed anode assembly of the instant invention located therein.

Referring now in greater deatil to the various figures of the drawing wherein like reference numerals refer to like parts, there is shown in FIG. 1 a deep bed anode assembly 20 constructed in accordance with the instant invention for use in an impressed current cathodic protection system.

The cathodic protection system in its entirety is arranged to provide cathodic protection to buried, corrosion-prone structures, e.g., pipelines, etc., (not shown). The cathodic protection system itself is conventional and basically comprises a recitifier/controller unit (or some other source of current) mounted above ground at a remote location from the anode bed, but connected thereto via its positive terminal. The anode assembly, is disposed within a deep bore hole 22 in the ground 24 adjacent the structure to be protected. The negative side of the rectifier or current source is connected to the buried structure to complete the impressed current path.

The bore hole 22 is formed by conventional drilling techniques and can extend from 100 to 800 or more feet below the surface. The diameter of the bore hole is approximately 8 inches. At the mouth of the bore hole there is located a conventional steel casing 26 to prevent the overburden from collapsing in the bore hole. An electrically conductive, granular material, such as coke breeze, is disposed within the hole.

The use of coke breeze in deep well anode beds is conventional to expedite the passage of impressed current from the anode to the buried structure. The coke breeze 28 is located within the hole for a substantial portion of the depth, which portion is a function of the ground resistance, ground water content, number of anode beds, location of the underground structure, etc. The interior of the bore hole above the coke breeze level is back filled with gravel 30 or some other loose fill. The gravel 30 may extend for a depth up to several hundred feet, again depending upon the application.

The assembly 20 of the instant invention basically comprises a continuous, dual feed anode assembly 32, a bottom assembly 34, anode assembly replacement guide means 36, anode assembly holding conduit means 38 and 40, and vent conduit means 42.

Figure 2:
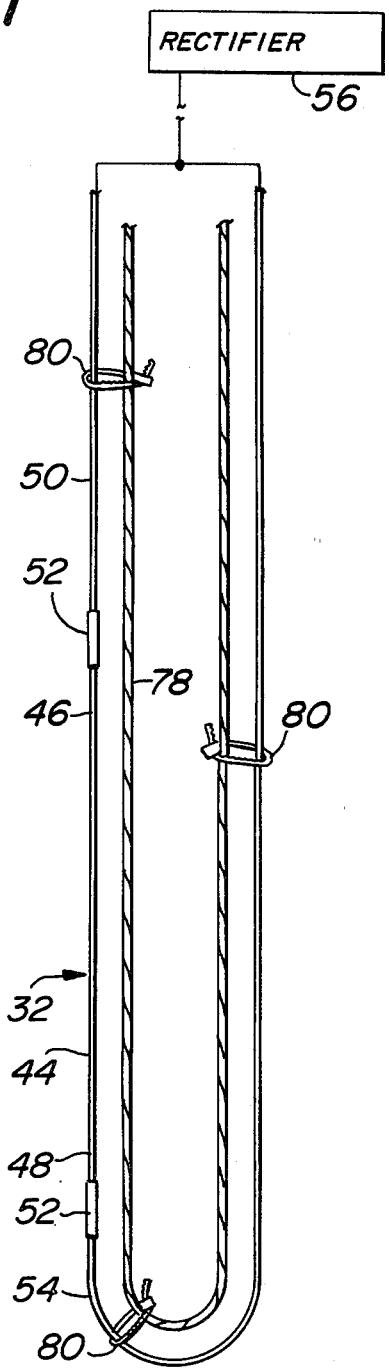
FIG. 2 is a side elevational view of the anode assembly and guide means forming a portion of the deep bed anode assembly shown in FIG. 1.

Referring now to FIG. 2 the details of the anode assembly 32 will be described. As can be seen the anode assembly 32 is of the "continuous type" and basically comprises an elongated wire extending substantially the entire length of the portion of the bore hole in which the coke breeze 28 is located. The wire can be formed of any suitable material, such as niobium, tantalum, titanium, etc. and is preferably coated with platinum.

The anode 44 includes an upper end 46 and a lower end 48. The upper end 46 is electrically connected to a flexible electrical conductor or cable 50 at a splice joint 52. The lower end 48 of the anode 44 is connected to an electrical conductor 54 at a second splice joint 52. The cables are preferably insulated. The splices at the joints 52 can be effected in any conventional manner, such as soldering, crimping, etc. A waterproof insulating material is preferably placed over the splice by various conventional techniques, such as the use of a heat shrinkable plastic sleeve.

As clearly shown in FIGS. 1 and 2 the anode assembly 32, when located in the bore hole, is disposed in a generally U-shaped configuration. In this configuration the anode 44 itself is located approximately centrally throughout the entire coke breeze portion (column) in the bore hole. The conductor 50 extends upward, through the anode assembly holding conduit means 40 to the top of the bore hole for electrical connection to the positive terminal of the current source disposed remotely from the anode. The other conductor 54 extends through the bottom assembly 30 in a manner to be described later, and back up through the anode assembly holding conduit means 38 to the top of the bore hole for electrical connection to conductor 50.

The conduits 38, 40 and 42 and the bottom assembly serve the means for holding the anode assembly in position as just described, with the anode itself being in direct electrical continuity with the coke breeze and located radially in the center of the bore hole, while also facilitating the replacement of the anode assembly if such is required.

The conduit means 38 comprises a plurality of generally linear, hollow, non-metallic pipe sections 58 which are interconnected, via interposed connecting sleeves 60. The sleeves extend about the peripheral edges of the abutting portions of the pipe sections and are secured thereto to form a joint therebetween. The conduit means 38 extends from the top of the bore hole to the bottom assembly 34.

The use of plural interconnected pipe sections 58 is selected in order to facilitate the assembly of the device 20 at the site as will be described later. However, for certain applications, e.g., relatively shallow depth "deep anode beds," a single pipe section 38 may be all that is required to extend the full length of the bore hole.

The conduit means 40 is in the form of a chute and comprises a single, linear, hollow pipe section which is mounted on the uppermost portion of the conduit 38 contiguous with the top of the bore hole. The chute 40 extends the full depth of the gravel filled section 30 of the bore hole and slightly into the coke breeze 28 column. It must be pointed out at this juncture that while only a single pipe section 40 is shown in FIG. 1 to make up the chute, plural sections can be connected together in a manner similar to the connection of sections 58 of the conduit means 38 if the chute is to extend to depths greater than the length of any given pipe section. In either construction the lower end 62 of the chute conduit 40 extends a short distance (e.g., 2 feet) into the coke breeze 28.

The chute 40 is secured to conduit 38 via the use of plural, rigid jumper straps 64. The straps are secured to the respective conduit portions by an adhesive.

The vent conduit means 42 is provided to vent gases produced during anode operation to the surface. To that end conduit means 42 extends the full length of the bore hole to the bottom assembly 34 and is constructed in a similar manner to conduit means 38, except that the conduit means 42 includes a multitude of perforations 66 in the portion thereof extending through the coke breeze column of the bore hole. The remaining sections of the conduit means 42, that is the pipe sections extending through the gravel or fill 30, are unperforated. The vent conduit means 42 is also secured to the conduit means 38 and 40 via plural jumper straps 64.

The bottom assembly 34 basically comprises a weighted base member 68 having a generally U-shaped conduit section or elbow 70 embedded therein. The conduit section 70 includes a short upwardly projecting stub portion 72 and a longer upwardly extending stub portion 74. The top of the stub portion 74 is connected to the lowermost pipe section 58 of the conduit 38 via a connecting sleeve 60 in the same manner as described heretofore. The elbow 70 serves as means for directing a 180° directional change in the anode assembly cable to enable the downwardly extending portion of the anode assembly cable to be directed upward and back to the top of the bore hole.

The conduits 40, 70 and 38 serve as the means for holding the anode assembly within the bore hole at the desired position and for also providing a clear, low friction path through the bore hole for the anode assembly to enable ready replacement of the anode assembly without requiring digging up or removing the entire assembly 20. To that end, the anode assembly 32 is located as follows: The upper conductor or cable 50 extends through chute 40 and out the top thereof for electrical connection to the positive side of the rectifier 56. The upper splice 52 is disposed within the conduit 40, slightly above its bottom end 62. Since the bottom end 62 of the chute extends slightly below the top of the coke breeze column in the bore hole, the splice is isolated from the coke breeze. The anode 44 extends downward through the coke breeze column and enters into the top of the short stub conduit 72 of the base assembly 34. The short stub conduit section 72 is located slightly laterally of the longitudinal axis of conduit 40, but the offset is so slight as compared to the length of the anode that for all intents and purposes the anode is centered within the coke breeze column of the bore hole when the base assembly is in its normal position as shown in FIG. 1. The splice 52 at the lower end 48 of the anode 44 is located within the stub section 72, with the conductor 54 extending downward, through the U-shaped elbow 70, upward through the stub section 74, into the conduit means 38 and up therethrough to the surface for electrical connection to the conductor 50 and hence to the positive anode of the rectifier 56.

The isolation of the upper splice from the coke breeze minimizes the changes of corrosion at the splice. Since the lower splice 52 is located within the upwardly extending stub 72 of the base assembly, and hence is subject to contact with the coke breeze which would otherwise fall therein, a seal 76 is provided to close the open end of the stub 72 about the periphery of the anode thereby precluding the ingress of coke breeze into the bottom assembly and into contact with the splice.

The guide means 36 serves as a back up mechanism for effecting replacement of an anode assembly in the event of a break in both conductors 50 and 54 or both splices 54 or in the event that the primary anode replacement method (to be described later) is not desired or unavailable.

As can be seen clearly in FIG. 2, the guide means 36 basically comprises an elongated flexible member, e.g., rope, which extends parallel to the anode assembly and is threaded through the conduits in the same manner as the anode assembly. The rope 78 is preferably formed of a man-made material which is resistant to Chlorine. The rope 78 is attached to the anode assembly 32 by a plurality of conventional, encircling ties 80.

As will be appreciated from the foregoing, the conduits through which the anode assembly and the guide means pass provide a clear, unobstructed, low friction path through the bore hole. Thus, a replacement anode assembly can be readily threaded into position, unimpeded by the material filling the hole. Moreover, the conduits 40 and 72 effect the centralization of the exposed anode within the the coke breeze column.

The perforations 66 in the vent conduit section 42 enable Chlorine or other gas generated during operation of the cathodic protection system to pass from the coke breeze into the conduit 42 and up to the surface. In addition, the perforations provide means for effecting fluidization of the coke breeze, when such action is desired, as will be described later.

The weighted base 68 of the bottom assembly is shown clearly in FIGS. 1 and 6. The base is a generally bucket-shaped member, preferably formed of concrete to keep it from floating up in the event that there is water in the bore hole, (a common occurrence), and to prevent the assembly from snagging as it is lowered into the bore hole. A rope 82 is connected to the base via a ring 84. The rope 82 is longer than the maximum depth of the bore hole and provides the means for lowering the base assembly into the bore hole.

In accordance with the preferred embodiment of the instant invention all of the conduits of the assembly are preferably formed of a plastic material, such as acrylonitrile-butadiene-styrene (ABS).

As will be appreciated from the foregoing, the anode 44 of the anode assembly 32 is a dual feed-type. By dual feed it is meant that there are two electrical conductors connected thereto and to impressed current source, e.g., the rectifier. Thus, even in the event that there is a failure of one splice 52 or one conductor, 50 or 54, the anode 44 still remains viable and in operation, via the electrical continuity with the remaining splice and conductor. Thus, there is no need to replace the anode assembly.

In the event that there is a failure of both conductors and/or splices, the anode assembly can be readily replaced by guiding it through the conduits via use of the guide rope 78 as will be described later.

It must be pointed out at this juncture that the anode assembly 32 need not be replaced only after failure, but can be replaced on a periodic preventative basis, e.g., after a set number of years. In fact, such periodic replacement is the preferable manner of use of the invention.

The installation of the deep bed anode assembly 20 in the hole 22 is as follows: Once the hole is drilled and flushed of all debris, it is ready to receive the assembly. To that end the anode assembly 32 and the guide rope 78 is threaded through the bottom assembly and the associated conduit sections. The bottom assembly is then lowered into the hole, via the rope 82, until the weighted base 68 is on the bottom of the hole. The tapered bucket shape of the base facilitates the lowering of the assembly to the bottom of the hole and holds it in place relatively centered therein. As the assembly is lowered each pipe section making up the conduits 38, 40 and 42 is secured to the previous section, via the sleeves 60, until the assembly is completed. When completed the anode extends between the bottom of the upper conduit 62 and the short stub conduit 72, that is, through substantially the entire length of the bore hole which will have coke breeze therein. The coke breeze is then pumped into the bore hole, via a pipe (not shown), until it fills the desired depth of the hole to the height slightly above the bottom 42 of the chute conduit 40. The remainder of the hole is then filled with gravel or other loose back fill to ground level. The assembly 32 is then ready for connection to the rectifier by connecting the two conductors 50 and 54 together and to the positive side of the rectifier, via means (not shown).

As will be appreciated from the foregoing the replaceable deep anode bed assembly of this invention is simple in construction, can be readily installed and once in place is adapted for long, continuous operation. In the event it is desired to replace or renew the anode or if a failure should occur the invention enables the replacement of the anode assembly in a fast and simple process. In this regard, the removal of one anode assembly and the replacement by another anode assembly can be accomplished in one operation. Thus, the anode assembly to be replaced is connected to a small winch (not shown) at the top of the chute conduit 40. At the same time a new anode assembly is connected to the conductor end 54 extending out the top of conduit 38. The winch then removes the old anode and associated conductors while pulling the new anode and associated conductors into position through the communicating conduits. In accordance with the preferred embodiment of the invention the anode assembly is at a maximum a half inch (1.27 cm) in diameter, with the anode itself being from 0.03 to 0.5 inches in diameter, and thus will normally pass through the coke breeze column without impediment. However, should it become necessary, the coke breeze can be fluidized, that is, water can be pumped into the coke breeze via the perforated conduit 42.

In the event that there is a break in both conductors 50 and 54 or both splices the threading of the new anode assembly into position can be accomplished via the use of the guide rope 78 in a similar manner to that just described.

With the device of the instant invention even if there is a break in the anode assembly 32 and in the guide rope 78, a replacement anode can still be placed into the bore hole. To that end, all that is required is to pull as much of the guide rope 78 and anode assembly as possible out of the hole through the conduit 40. The coke breeze is then fluidized through the introduction of water into the hole via the perforated conduit 42. This action creates a low friction coke breeze slurry. A new weighted anode can then be lowered through the chute 40 so that it sinks through the coke breeze slurry into position.

In accordance with the commercial embodiment of the instant invention the anode 44 includes a thin copper coating on its surface to protect it from abrasion. This copper coating quickly dissipates once the anode is in place and energized.

As will be appreciated from the foregoing because the anode is continuous, that is extends the full length of the coke breeze column, there are no lead wire connections in the coke breeze back fill. Therefore, the usual point of anode failure is eliminated. Moreover, the dual feed of the anode assembly provides operational redundancy should there be a failure of one conductor or one splice. Further still, by virtue of the continuous nature of the anode exact anode placement does not have to be considered and the positioning problem of prior art individual anodes is eliminated. Thus, the anode is self centering. As is known centering of the anode in a coke breeze column is important to preclude its contact with the soil, which contact would shorten the life of the anode due unequal current distribution.

Without further elaboration the foregoing will so fully illustrate my invention that others may, by applying current or future knowledge, readily adapt the same for use under various conditions of service.

What is claimed as the invention is:

1. An anode assembly for use in a system for cathodically protecting underground metal structures and having a deep bore hole, said bore hole being filled with an electrically conductive material from the bottom of said bore hole to a first point in the bore hole, said anode assembly comprising a weighted bottom assembly arranged for disposition at the bottom of said bore hole, first conduit means extending the depth of said bore hole and connected to said bottom assembly, an electrically conductive longitudinally extending anode located generally outside said first conduit means yet within said bore hole between said bottom assembly and the top of the bore hole and substantially centrally within said bore hole for direct exposure to said electrically conductive material, said anode having an upper end to which a first conductor is connected and a lower end to which a second conductor is connected, said first conductor extending from said upper end of said anode through said bore hole for connection to rectifier means located outside of said bore hole, said second conductor extending through said base assembly and through said first conduit means to the top of said bore hole for connection to said rectifier means wherein removal and replacement of said anode is readily accomplished by pulling said second conductor through said first conduit means to the outside of said bore hole.

2. The anode assembly of claim 1 wherein said electrically conductive material is granular, said first point is located below the top of said bore hole and said assembly also comprising second conduit means located beside the first conduit means and extending downward to a point adjacent said first point, said first conductor extending through said second conduit means.

3. The anode assembly of claim 2 wherein said anode is a wire which extends between said bottom assembly and said second conduit means.

4. The anode assembly of claim 3 additionally comprising third conduit means disposed beside and first conduit means and extending the length of said bore hole, said third conduit means being perforated in the portion of the bore hole in which said electrically conductive granular material is located.

5. The anode assembly of claim 4 wherein said first, second and third conduit means are secured to one another to form a unitary assembly.

6. The anode assembly of claim 5 wherein said first, second and third conduit means are each formed of plastic.

7. The anode assembly of claim 2 additionally comprising elongated flexible guide means connected to said first and second conductors and extending from a point adjacent the top of the bore hole, through said second conduit means, down the length to the bore hole through said granular material, through said bottom assembly and up through said first conduit means to said point adjacent the top of said bore hole.

8. The anode assembly of claim 7 wherein said guide means comprises a rope.

9. The anode assembly of claim 1 additionally comprising third conduit means disposed beside said first conduit means and extending the length of said bore hole, said third conduit means being perforated in the portion of the bore hole in which said electrically conductive granular material is located.

10. The anode assembly of claim 9 wherein said bottom assembly comprises a weighted base having arcuate conduit means extending therethrough, said arcuate conduit means providing a path through which said second conductor passes.

11. The anode assembly of claim 10 wherein said arcuate conduit means includes a pair of open ends, first conduit means is connected to said arcuate conduit means at one end thereof.

12. The anode assembly of claim 11 additionally comprising short conduit means mounted on said bottom assembly, extending upward therefrom and connected to the other end of said arcuate conduit means, said lower portion of said wire anode extending through said short conduit means.

13. The anode assembly of claim 12 additionally comprising seal means on said short conduit means for preventing the ingress of the electrically conductive granular material into the interior of said short conduit means.

14. The anode assembly of claim 13 wherein said first conduit means, second conduit means, third conduit means, arcuate conduit means and short conduit means are formed of plastic.

15. The anode assembly of claim 14 wherein said weighted base comprises a generlaly bucket-shaped concrete body.

16. The anode assembly of claim 15 additionally comprising second rope means connected to said concrete body for enabling said body to be lowered to the bottom of said bore hole.

17. The anode assembly of claim 16 additionally comprising elongated flexible guide means connected to said first and second conductors and extending from a point adjacent the top of the bore hole, through said second conduit means, down the length of the bore hole through said granular material, through said bottom assembly and up through said first conduit means to said point adjacent the top of said bore hole.

18. The anode assembly of claim 17 wherein said guide means comprises a rope.

19. The anode assembly of claim 1 comprising means secured to said bottom assembly for lowering the bottom assembly to the bottom of the bore hole.

20. The anode assembly of claim 19 wherein said means comprises rope means.

21. An anode assembly for use in a system for cathodically protecting underground metal structures and having a deep bore hole, said bore hole being filled with an electrically conductive material from the bottom of said bore hole to a first point in the bore hole, said anode assembly comprising a weighted bottom assembly arranged for disposition at the bottom of said bore hole, said bottom assembly including a weighted base with arcuate conduit means extending therethrough, an electrically conductive longitudinally extending anode located within said bore hole and between said bottom assembly and the top of the bore hole and substantially centrally within said bore hole for direct exposure to said electrically conductive material, said anode having an upper end to which a first conductor is connected and a lower end to which a second conductor is connected, said first conductor extending through said bore hole for connection to rectifier means located outside of said bore hole, said second conductor extending through said arcuate conduit means of said base assembly and said bore hole for connection to said rectifier means wherein removal of said anode is readily accomplished by pulling said conductors and said anode through said bore hole to the outside thereof.

22. The anode assembly of claim 21 comprising means secured to said bottom assembly for lowering said bottom assembly to the bottom of said bore hole.

23. The anode assembly of claim 22 wherein said means comprises rope means.

24. The anode assembly of claim 21 wherein said weighted base comprises a generally bucket-shaped concrete body.

* * * * *